US006361480B1

(12) United States Patent
Coram

(10) Patent No.: US 6,361,480 B1
(45) Date of Patent: Mar. 26, 2002

(54) MARTIAL ARTS TRAINING DEVICE

(76) Inventor: Stephen Coram, 288 Olivia St., Port Chester, NY (US) 10573

( * ) Notice: Subject to any disclaimer, the term of this patent is extended or adjusted under 35 U.S.C. 154(b) by 0 days.

(21) Appl. No.: 09/514,102

(22) Filed: Feb. 28, 2000

(51) Int. Cl.[7] ..... A63B 21/00
(52) U.S. Cl. ..... 482/83; 44/126
(58) Field of Search ..... 482/139, 24, 23, 482/148, 33, 49, 106, 126, 140, 44; 269/75; 70/15–18; 602/5, 16, 24

(56) References Cited

U.S. PATENT DOCUMENTS 1,821,566 A * 9/1931 Neal ..... 70/16
2,815,021 A * 12/1957 Freeman ..... 602/24
5,362,305 A * 11/1994 Varn ..... 602/24
5,624,359 A * 4/1997 Dean ..... 482/91

* cited by examiner

*Primary Examiner*—Jerome W. Donnelly
(74) *Attorney, Agent, or Firm*—Bucknam and Archer

(57) ABSTRACT

There is provided a martial arts training device for use by a martial arts practitioner to develop hand coordination, hand spacing, speed and timing in close quarter combat training exercises. The training device consists of two rigid rings held together at their peripheries along a common diametric by a universal type coupling. Each ring is adapted to encircle a forearm of the practitioner and permits limited independent hand movement so as to enable the practitioner to practice various exercises of close quarter combat training.

6 Claims, 4 Drawing Sheets

MARTIAL ARTS TRAINING DEVICE

The present invention relates generally to a martial arts training device for use by martial artists and boxers in close quarter training exercises for the development of proper hand spacing, coordination, speed and timing and, more particularly, it relates to such a martial arts training device which is worn on the forearms of the practitioner and which permits restricted coordinated movements of the hands of the practitioner in simulated martial arts close quarter combat training exercises.

It is well known that in order to become proficient at any of the various martial arts' disciplines as well as boxing and to maintain that proficiency once it is acquired, it is essential for the practitioner to continuously train and practice the various exercises and movements demanded by the particular discipline. Obviously, the best training method which can be employed by a martial arts' practitioner is to train with a partner so that offensive and defensive moves and exercises can be practiced in simulated combat. However, it is not always possible to have a partner available for such training exercises and thus the practitioner must practice the movements of the various exercises by himself such as a boxer would shadowbox. In addition, a few training devices have been developed to aid the practioner in his or her solitary or solo training, such as the wing chun dummy, various punching bags, etc. The wing chun dummy consists of a large diameter vertical pole or post having a number of horizontally extending limbs which permits the practioner to train in close quarter blocking, trapping and striking techniques. Punching bags can take the form of the speed bag for hand-eye coordination, the heavy bag for power, etc. Such training devices tend to be large and cumbersome and suitable for use in gyms and other specially designated training areas and are essentially incapable of easy conveyance or transport at the inclination of the practioner.

It is, therefore, a primary object of the present invention to provide a martial arts training device for use by a martial arts practioner or a boxer which is of such a compact size and light weight as to be easily transportable and usable substantially anywhere and which is effective for the development of proper hand spacing, coordination, speed and timing.

The above object is accomplished in accordance with the present invention by providing a martial arts training device consisting of a pair of rigid circular rings adapted to encircle the forearms of the user or martial arts practitioner, the rings being arranged adjacent one another along a common diametric and coupled together along the common diametric by a universal type coupling. The martial arts practitioner slips each forearm through one of the rigid rings of the training device and shadowboxes with an imaginary opponent. The training device constrains the practitioner's hands to maintain a proper spacing thereof while simultaneously permitting proper coordinated movement of the hands so that speed and timing are developed.

Other objects and features of the present invention will become apparent from the following detailed description considered in connection with the accompanying drawings, in which.

Figure 1:
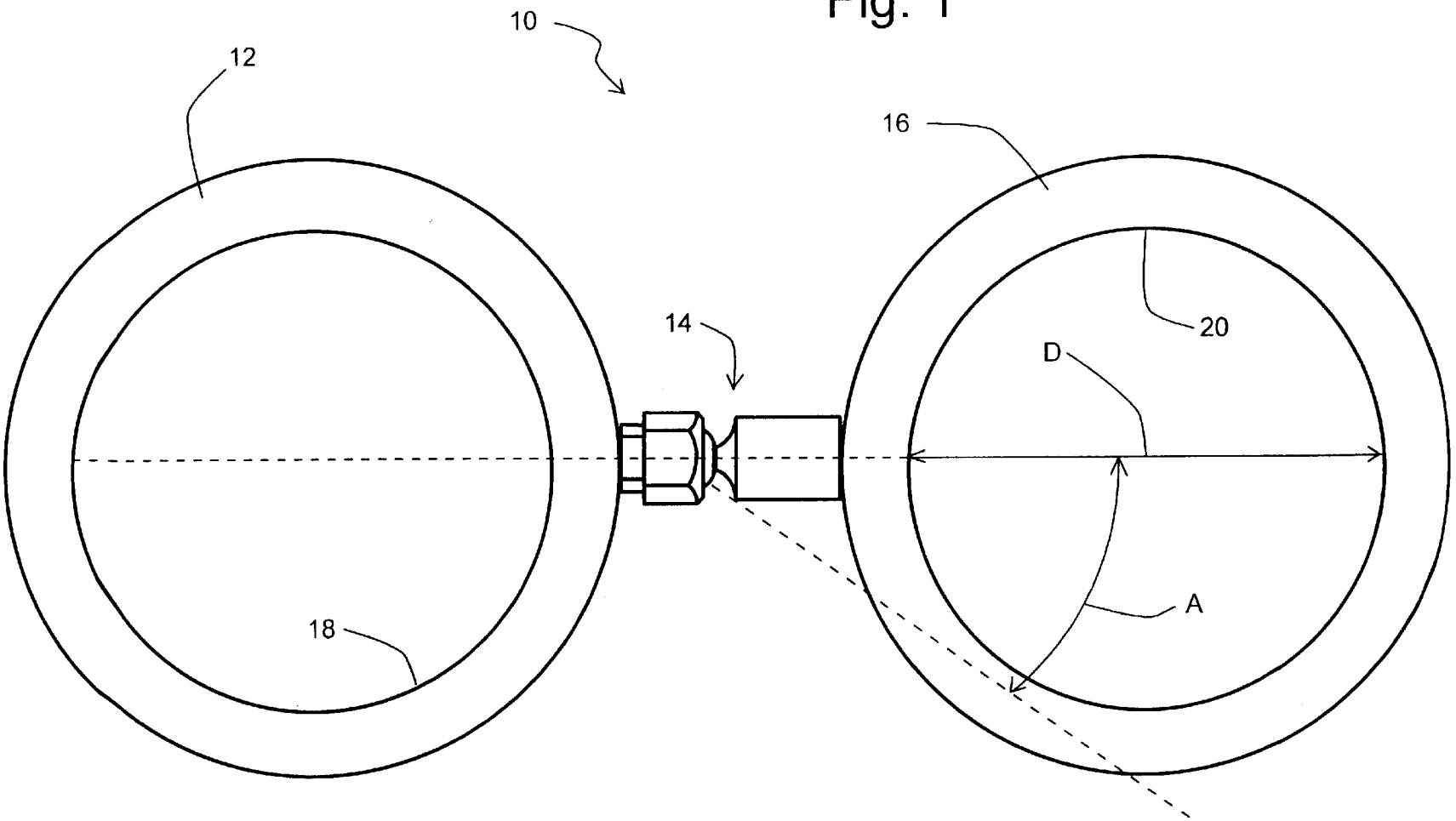
FIG. 1 is a plan view of the martial arts training device according to the present invention.

Now turning to the drawings, there is shown in FIG. 1 a martial arts training device according to the present invention, generally designated 10, including a first rigid circular ring 12 coupled at its periphery by coupling 14 to the periphery of a second rigid circular ring 16. The central openings 18 and 20, respectively, of rings 12 and 16 are large enough to allow the rings to encircle the forearms of the martial arts practitioner, as clearly seen in FIGS. 4 to 6. The proper size of central openings 18 and 20 for the individual practitioner is such that the ring 12 or 16 is free to move between three quarters the length of the practitioner's forearm and his elbow. If ring 12 or 16 is not large enough to freely move to a point at least three quarters of the length of the forearm, it is too small.

Since the purpose of martial arts training device 10 is to help develop the practitioner's hand spacing, coordination, speed and timing, the weight of rigid rings 12 and 16 should not be significant so that quick, independent movement of the practitioner's hands during the various exercise movements is not hindered. On the other hand, some martial arts practitioners may also wish to increase the strength of their arms and shoulders and hence opt to have rigid rings 12 and 16 rather heavy. While heavier rigid rings 12 and 16 will result in slower exercise movements, the practitioner's goal of increased strength will be met.

Coupling 14, connecting rigid rings 12 and 16 together, is disposed along a common diametric, designated "D", of rings 12 and 16. Preferably, coupling 14 separates rigid rings 12 and 16 by about one to one and one half inches. In order to permit at least limited independent movement of the practitioner's hands during training exercises, coupling 14 is in the nature of a universal type coupling. However, it is also necessary that rings 12 and 16 do not collapse on each other during use and therefore coupling 14 must be somewhat rigid so as to thereby maintain a proper minimum spacing of the practitioner's hands and forearms during performance of the training exercises.

Figure 2:
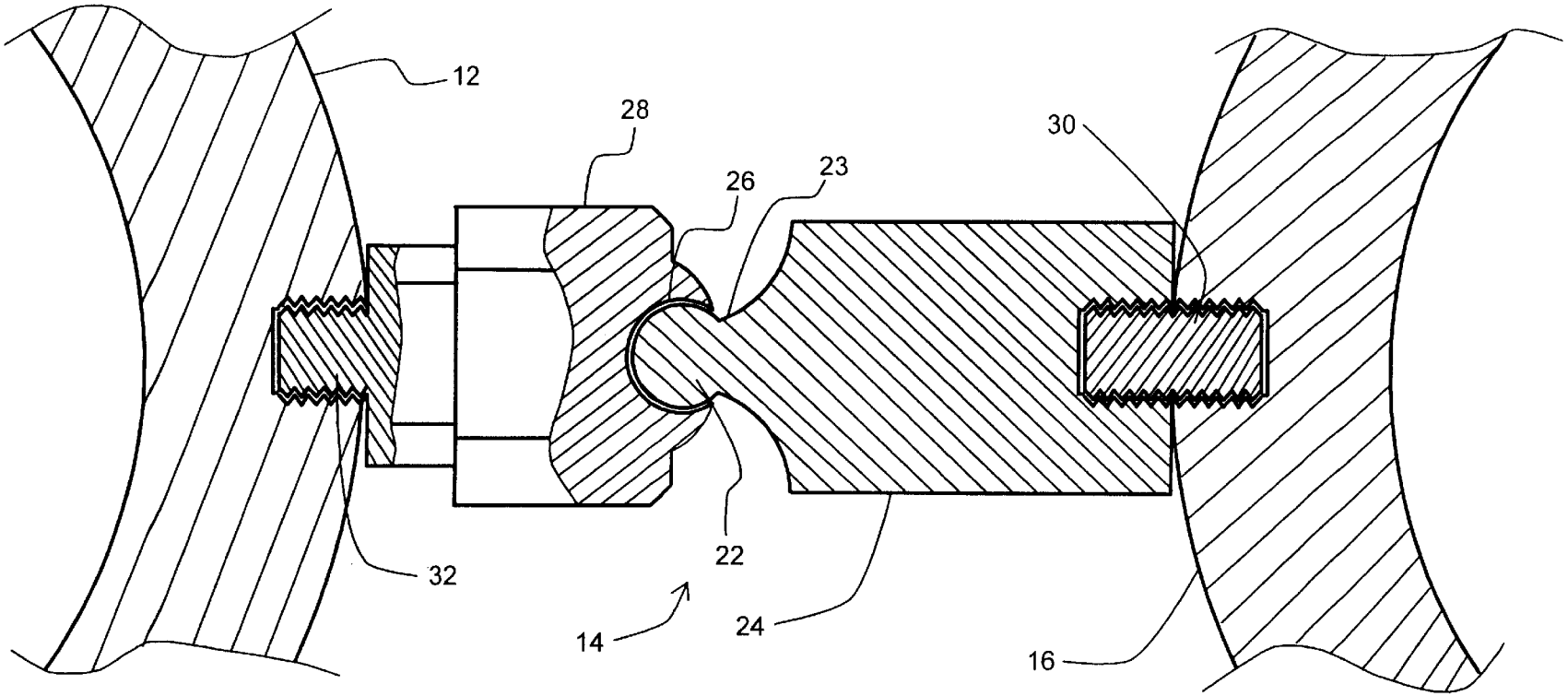
FIG. 2 is an enlarged partial cross-sectional view of the coupling element of the martial arts training device according to the present invention.
Figure 3:
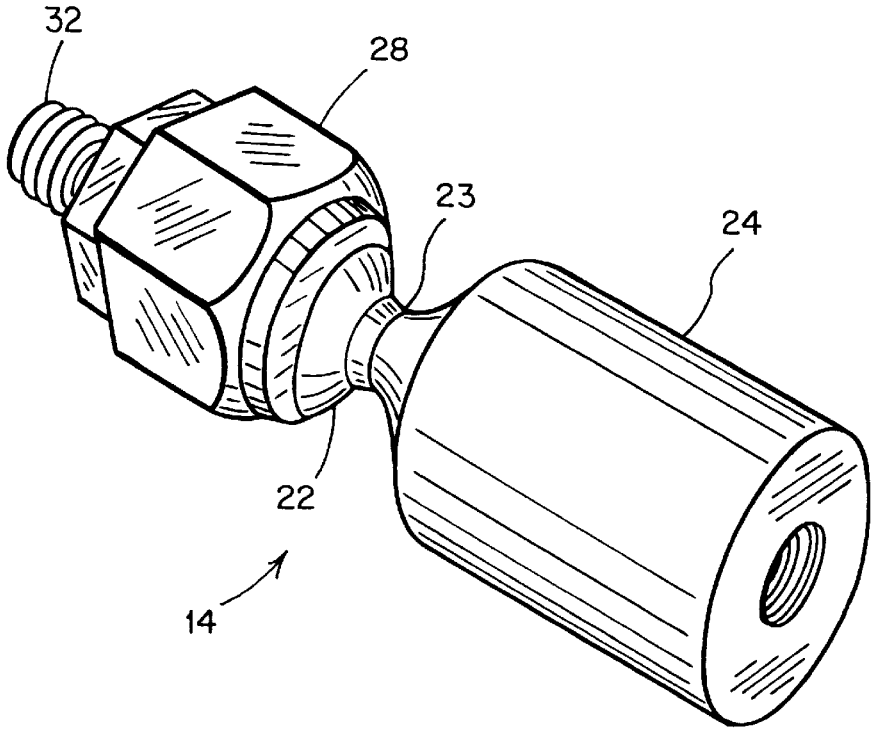
FIG. 3 is an enlarged perspective view of the coupling element of the martial arts training device according to the present invention.

The universal type coupling of coupling 14, as clearly seen in FIGS. 2 and 3, is preferably comprised of a ball and socket joint. The ball element, designated 22, of the ball and socket joint extends along the common diametric "D" from a base element 24 fixedly attached to the perimeter of rigid ring 16. The spherical socket,designated 26, is formed in a base element 28 fixedly attached to the perimeter of rigid ring 12 along the common diametric "D". Base elements 24 and 28 are fixedly attached to rigid rings 16 and 12 by threaded fasteners 30 and 32, respectively. However, any suitable fastening means which fixedly fastens the base elements to the rings may be used, such as welding, etc.

The factors limiting the relative movement of ball 22 in socket 26 are the diameter of stem 23 attaching ball 22 to base element 24 and the depth of spherical socket 26. The depth of spherical socket 26 must be such that socket 26 extends more than 180° around ball 22 in order to retain ball 22 therein. Also, the diameter of stem 23 must be great enough to give the coupling sufficient strength that it does not break during use. In order to accommodate these considerations and still permit sufficient relative movement of rings 12 and 16 to allow the practitioner to perform exercises, it is preferred that the ball and socket joint of coupling 14 permits limited relative movement of rigid rings 12 and 16 through an arc "A" of about 45°, as clearly seen in FIG. 1.

Because of the relative rigidity of the ball and socket joint of coupling 14, rigid rings 12 and 16 are incapable of collapsing on each other during use so that a minimum spacing of the rings and hence the practitioner's hands and forearms is maintained. As noted above, coupling 14 is preferably one to one and one half inches in length so that proper spacing is maintained between the rings 12 and 16. However, in the event a heavier training device with heavier rings is desired by the practitioner as noted above, coupling 14 must be correspondingly heavier and thus also somewhat longer so that rigid rings 12 and 16 will be separated by a distance somewhat greater than the preferred one to one and one half inches.

Figure 4:
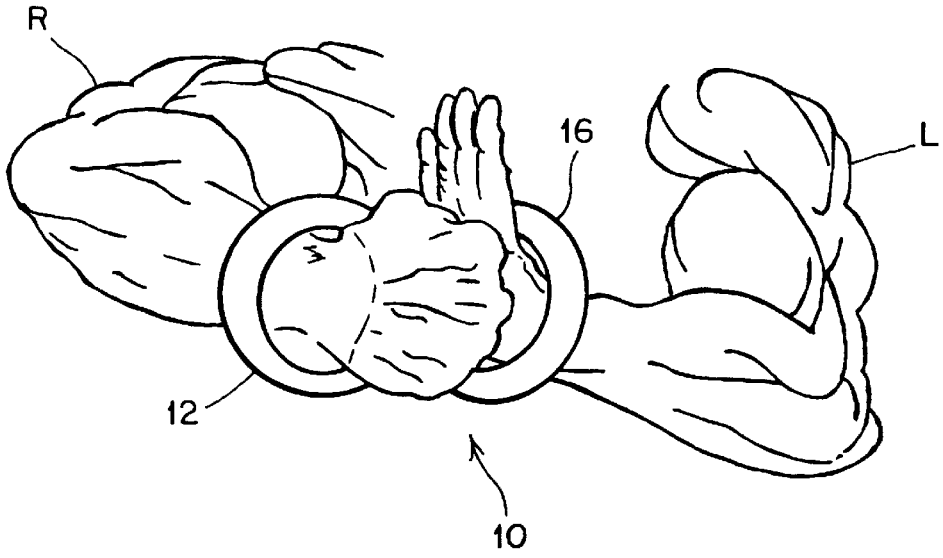
FIGS. 4 to 6 are views of the martial arts training device according to the present invention in actual use by a martial arts practitioner.
Figure 5:
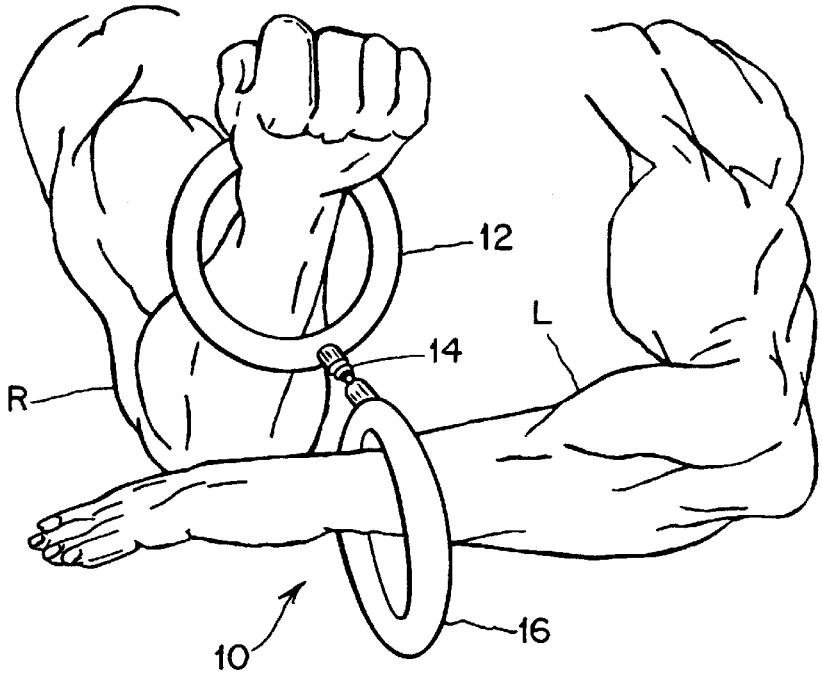
Figure 6:
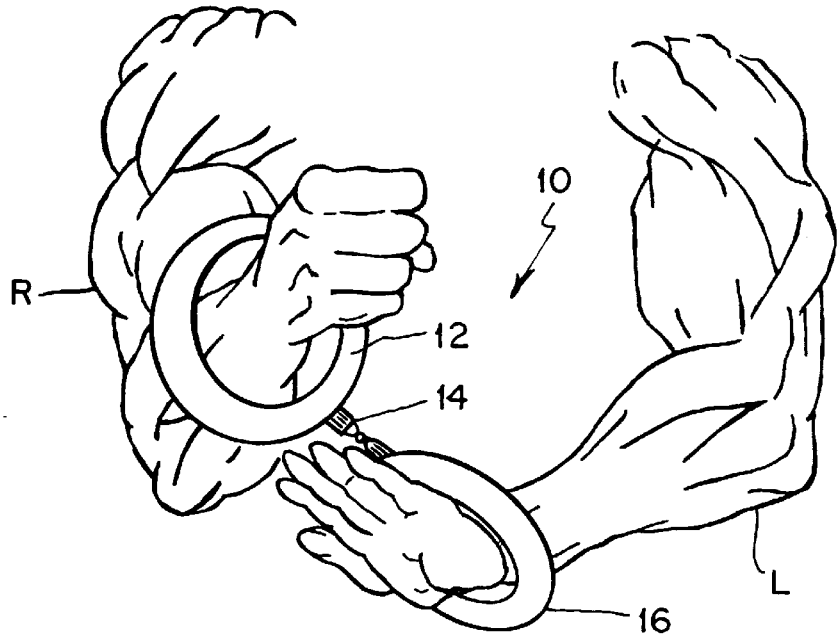

FIGS. 4, 5 and 6 show martial arts training device 10 in actual use. As clearly seen, rigid ring 12 encircles the right forearm "R" of the practitioner and rigid ring 16 encircles the left forearm "L" of the practitioner. As noted above and as clearly seen in FIGS. 4, 5 and 6, training device 10 is ideal for close quarter combat training exercises to help develop hand coordination, hand spacing, speed and timing. The training device is suitable for martial arts practitioners, boxers or anyone who desires to perform exercises relating to close quarter combat. As can be seen, training device 10 is compact and light weight so as to be easily carried by the practitioner in a briefcase, etc. and can be used almost anywhere the practitioner desires.

It is to be understood that the foregoing general and detailed descriptions are explanatory of the present invention and are not to be interpreted as restrictive of the scope of the following claims.

What is claimed is:

1. A martial arts training device for use by a martial artist or a boxer in close quarter training exercises for the development of proper hand spacing, coordination, speed and timing, said training device consisting of:

a) a first continuous rigid ring member adapted to encircle a first forearm of the user, the perimeter of said first ring member having a female coupling adapter; and b) a second continuous rigid ring member adapted to encircle a second forearm of the user, the perimeter of said second ring member having a male coupling adapter, said male coupling adapter and said female coupling adapter being coupled together so that said first and second ring members are independently rotatable through 360° about a common diametric of said first and second ring members and each ring member is pivotable about the coupling of said male and female adapters, whereby in using said training device in close quarter training exercises the user's hands are maintained at a proper spacing one from the other while otherwise being completely independently movable.

2. The martial arts training device as defined in claim 1, wherein said first and second rigid ring members are dimensioned to fit over the user's forearms to at least three quarters the length thereof.

3. The martial arts training device as defined in claim 1, wherein said male and female coupling adapters when coupled separate the peripheries of said first and second rigid ring members at least one to one and one half inches.

4. The martial arts training device as defined in claim 1, wherein said male and female coupling adapters form a ball and socket joint.

5. The martial arts training device as defined in claim 1, wherein said male and female coupling adapters when coupled permit pivotable movement thereabout of one of said first and second rigid ring members with respect to the other one of said first and second rigid ring members through an angle of about 45 degrees from said common diametric.

6. The martial arts training device as defined in claim 1, wherein the male coupling adapter extends along said common diametric from a base element fixedly attached to the periphery of said frist rigid ring member, and the female coupling adpater is formed along said common diametric in a base element fixedly attached to the periphery of said second rigid ring member.

* * * * *